US008166935B2

(12) United States Patent
Eiraku et al.

(10) Patent No.: US 8,166,935 B2
(45) Date of Patent: May 1, 2012

(54) CONTROL SYSTEM OF INTERNAL COMBUSTION ENGINE

(75) Inventors: Akira Eiraku, Sunto-gun (JP); Jouji Yamaguchi, Anjo (JP)

(73) Assignees: Toyota Jidosha Kabushiki Kaisha, Toyota-shi (JP); Denso Corporation, Kariya-shi (JP)

( * ) Notice: Subject to any disclaimer, the term of this patent is extended or adjusted under 35 U.S.C. 154(b) by 336 days.

(21) Appl. No.: 12/594,457

(22) PCT Filed: Mar. 31, 2008

(86) PCT No.: PCT/JP2008/056825

§ 371 (c)(1),
(2), (4) Date: Nov. 23, 2009

(87) PCT Pub. No.: WO2008/123613

PCT Pub. Date: Oct. 16, 2008

(65) Prior Publication Data

US 2010/0126449 A1 May 27, 2010

(30) Foreign Application Priority Data

Apr. 3, 2007 (JP) ..... 2007-097651

(51) Int. Cl.
*F01L 1/34* (2006.01)

(52) U.S. Cl. ..... 123/90.17; 123/90.15; 123/508; 464/160

(58) Field of Classification Search ..... 123/90.15, 123/90.16, 90.17, 90.18, 495, 508; 464/1, 464/2, 160
See application file for complete search history.

(56) References Cited

U.S. PATENT DOCUMENTS

| | | | |
|---|---|---|---|
| 5,040,500 | A | 8/1991 | Reece |
| 5,235,939 | A | 8/1993 | Levin et al. |
| 5,603,303 | A | 2/1997 | Okajima et al. |
| 5,666,914 | A | 9/1997 | Ushida et al. |
| 5,899,181 | A | 5/1999 | Kurata et al. |

(Continued)

FOREIGN PATENT DOCUMENTS

| | | |
|---|---|---|
| DE | 100 31 734 A1 | 1/2002 |

(Continued)

OTHER PUBLICATIONS

Supplementary European Search Report dated Jan. 2, 2012, in European Patent Application No. 08 73 9931, pp. 1-8, (in English).

*Primary Examiner* — Ching Chang
(74) *Attorney, Agent, or Firm* — Oblon, Spivak, McClelland, Maier & Neustadt, L.L.P.

(57) ABSTRACT

A control system of an internal combustion engine changing an operating timing of a valve in an internal combustion engine where a valve drive cam (13) and a pump drive cam (150) are both provided on a valve camshaft (1) is provided. That control system has a device inhibiting the operating timing from being returned in a direction reverse to the direction of the target operating timing during change of the operating timing. Further, in the control system, the relative rotational phases of the valve drive cam and the pump drive cam are set considering utilization of the composite reaction torque of the valve operation drive reaction torque and the fuel pump drive reaction torque acting on the valve camshaft for changing the operating timing in the direction of the target operating timing.

9 Claims, 3 Drawing Sheets

U.S. PATENT DOCUMENTS

| | | | | |
|---|---|---|---|---|
| 7,637,236 | B2 * | 12/2009 | Ochiai et al. | 123/90.33 |
| 2004/0144348 | A1 | 7/2004 | Simpson et al. | |
| 2005/0103297 | A1 | 5/2005 | Simpson | |
| 2005/0284433 | A1 | 12/2005 | Yaoko et al. | |

FOREIGN PATENT DOCUMENTS

| | | | |
|---|---|---|---|
| EP | 0 518 529 | A1 | 12/1992 |
| GB | 1117816 | | 6/1968 |
| GB | 2 167 524 | A | 5/1986 |
| JP | 8 121123 | | 5/1996 |
| JP | 10 176508 | | 6/1998 |
| JP | 2001 227425 | | 8/2001 |
| JP | 2003 328707 | | 11/2003 |
| JP | 2005 76482 | | 3/2005 |
| JP | 2006 29093 | | 2/2006 |
| JP | 2006 46315 | | 2/2006 |
| JP | 2006 207440 | | 8/2006 |
| WO | WO 2006/127348 | A1 | 11/2006 |

* cited by examiner

CONTROL SYSTEM OF INTERNAL COMBUSTION ENGINE

TECHNICAL FIELD

The present invention relates to a control system of an internal combustion engine. More particularly, it relates to a control system of an internal combustion engine changing an operating timing of a valve of a cylinder of the internal combustion engine.

BACKGROUND ART

Known in the art is an internal combustion engine provided with an operating timing changing mechanism changing the operating timing of a valve of a cylinder of the internal combustion engine in accordance with the operating conditions etc. Further, as such an operating timing changing mechanism, one controlled by oil pressure is known. That is, for example, it is configured so that when advancing a valve operating timing, it supplies working oil through an advancing side oil path to an advancing oil pressure chamber and drains working oil through a retarding side oil path from a retarding oil pressure chamber so as to operate an oil pressure operating actuator and advance a rotational phase of a valve drive cam. Further, it is configured so that conversely when retarding a valve operating timing, it supplies working oil through a retarding side oil path to a retarding oil pressure chamber and drains working oil through the advancing side oil path from the advancing oil pressure chamber to operate the oil pressure operating actuator and retard the rotational phase of the valve drive cam.

Further, it is known to provide the advancing side oil path and retarding side oil path with valves able to act as check valves at any time to prevent the working oil from ending up flowing in reverse from the intended direction.

Further, known in the art is an internal combustion engine configured providing a valve camshaft driving operation mechanism of a valve of a cylinder of the internal combustion engine with not only valve drive cams, but also a pump drive cam so as to drive a fuel pump of the internal combustion engine. Further, when providing the valve camshaft with a pump drive cam in this way, the valve camshaft receives fluctuations in the reaction torque accompanying drive of valve operation (valve operation drive reaction torque) and also fluctuations in the reaction torque accompanying drive of the fuel pump (fuel pump drive reaction torque).

That is, more specifically, the valve operation drive reaction torque acts as torque in a direction inhibiting rotation of the valve camshaft (positive torque) since the valve spring is compressed in a period before a maximum position of cam lift for driving a valve in the opening direction during operation of the valve drive cam and acts as a torque in a rotating direction of the valve camshaft (negative torque) due to a springback force of the valve spring in a period after the maximum position of the cam lift for driving a valve in the closing direction. Further, the fuel pump drive reaction torque as well, in the same way as the valve operation drive reaction torque, acts as a torque in a direction inhibiting rotation of the valve camshaft (positive torque) in a period before the maximum position of the cam lift during operation of the pump drive cam and acts as a torque in a rotating direction of the valve camshaft (negative torque) in a period after the maximum position of the cam lift.

Further, the valve camshaft is acted on by a composite reaction torque of the valve operation drive reaction torque and the fuel pump drive reaction torque combined, but if the maximum value or amount of fluctuation of this composite reaction torque becomes larger, the torque required for driving the valve camshaft will become larger, the members transmitting power from the crankshaft to the valve camshaft (for example, the timing chain, timing belt, timing gear, etc.) will fall in lifetime, and other problems will arise.

Therefore, in the prior art, to deal with this problem, the practice has been to set the rotational phase of a valve drive cam and the rotational phase of the pump drive cam so as to flatten such a composite reaction torque and so that its maximum value becomes smaller or so that the amount of fluctuation of such a composite reaction torque becomes smaller (for example, see Japanese Patent Publication (A) No. 2001-227425, Japanese Patent Publication (A) No. 2006-207440, and Japanese Patent Publication (A) No. 2006-29093).

SUMMARY OF INVENTION

In this regard, in an internal combustion engine in which a valve drive cam and a pump drive cam are both provided at a valve camshaft in this way, when an operating timing changing mechanism controlled by oil pressure as explained above is used, the response of that control is greatly influenced by not only the pressure of the working oil, but also the composite reaction torque of the valve operation drive reaction torque and the fuel pump drive reaction torque. This is because the oil pressure operating actuator for changing the rotational phase of the valve drive cam is ultimately operated by the composite torque of the drive torque generated by the pressure of the working oil and the composite reaction torque.

That is, in the case of trying to changing the rotational phase of a valve drive cam to a targeted rotational phase, when a composite reaction torque of a magnitude of the drive torque generated by the pressure of the working oil or more acts in an opposite direction, it is not possible to make the rotational phase of the valve drive cam approach the targeted rotational phase, so if that period is long, the response of control deteriorates. Further, even if the drive torque generated by the pressure of the working oil is larger than the composite reaction torque acting in the opposite direction, if that difference is small, a sufficient response cannot be obtained.

On the other hand, conversely, if the composite reaction torque acts in the same direction as the drive torque generated by the pressure of the working oil, it is possible to easily make the rotational phase of the valve drive cam approach the targeted rotational phase, so if that period is long, response of control is improved. Furthermore, in this case, the larger the composite reaction torque, the faster the rotational phase of the valve drive cam can be made to approach the targeted rotational phase, so the more the response of control is improved.

Further, the effect of the composite reaction torque on the response is particularly remarkable when the pressure of the working oil is low, for example, when the engine speed is low.

Here, if, like in the above prior art, considering the cases of flattening the composite reaction torque, in these cases, the composite reaction torque is flattened and the maximum value is made small or the amount of fluctuation of the composite reaction torque is made to become smaller, the result is that the period in which a torque in the direction inhibiting the rotation of the valve camshaft (positive torque) acts becomes longer. Therefore, in such a case, there is a possibility that a sufficient response cannot be obtained in the case of advancing the valve operating timing. In particular, there is a concern that when the pressure of the working oil is low, the response will end up considerably deteriorating.

The present invention was made in consideration of the above problem, so the object is the provision of a control system of an internal combustion engine where both a valve drive cam and a pump drive cam are provided on a valve camshaft which can control the operating timing of a valve provided in a cylinder of the internal combustion engine with a good response.

The present invention provides a control system of an internal combustion engine described in the claims as means for solving this problem.

In a first aspect of the present invention, there is provided a control system of an internal combustion engine configured providing a valve camshaft provided with a valve drive cam for driving operation of a valve provided in a cylinder of the internal combustion engine with a pump drive cam so as to drive a fuel pump of the internal combustion engine, the system changing an operating timing of the valve provided in a cylinder of the internal combustion engine, wherein the control system has a device inhibiting the operating timing from being returned in a direction reverse to the direction of the targeted operating timing during change of the operating timing and relative rotational phases of the valve drive cam and the pump drive cam are set considering, for changing the operating timing in a direction of a targeted operating timing, utilization of a composite reaction torque of a valve operation drive reaction torque acting on the valve camshaft along with a driving operation of a valve provided in a cylinder of the internal combustion engine and a fuel pump drive reaction torque acting on the valve camshaft along with a driving operation of the fuel pump.

When, like in this aspect, having a device inhibiting the operating timing from being returned in a direction reverse to the direction of the targeted operating timing during change of the operating timing, that device is used to inhibit the operating timing from being returned in the reverse direction to the targeted operating timing during change of the operating timing, so there is no need to consider the composite reaction torque causing the operating timing to end up being returned in the reverse direction to the direction of the targeted operating timing. Therefore, in such a case, the composite reaction torque can be utilized for changing the operating timing in the direction of the targeted operating timing. For this reason, by setting the relative rotational phases of the valve drive cam and the pump drive cam considering the utilization of the composite reaction torque for changing the operating timing in the direction of the targeted operating timing, it becomes possible to efficiently utilize the composite reaction torque for control of the operating timing and becomes possible to improve the response of control of the operating timing.

Due to this, according to this aspect, in an internal combustion engine where both a valve drive cam and a pump drive cam are provided at a valve camshaft, it is possible to control the operating timing of a valve provided at a cylinder of the internal combustion engine with a good response.

In a second aspect of the present invention, there is provided a control system of an internal combustion engine configured providing a valve camshaft provided with a valve drive cam for driving operation of a valve provided in a cylinder of the internal combustion engine with a pump drive cam so as to drive a fuel pump of the internal combustion engine, the system changing an operating timing of the valve provided in a cylinder of the internal combustion engine, wherein the control system has a device inhibiting the operating timing from being returned in a direction reverse to the direction of the targeted operating timing during change of the operating timing and relative rotational phases of the valve drive cam and the pump drive cam are set so that an amount of fluctuation of value of a composite reaction torque of a valve operation drive reaction torque acting on the valve camshaft along with a driving operation of a valve provided in a cylinder of the internal combustion engine and a fuel pump drive reaction torque acting on the valve camshaft along with a driving operation of the fuel pump becomes maximum.

By configuring the system as in this aspect, it is possible to maximize the value of the composite reaction torque contributing to change of the operating timing in the direction of the targeted operating timing. As a result, in this aspect as well, like in the first aspect, in an internal combustion engine where both a valve drive cam and a pump drive cam are provided at a valve camshaft, it is possible to control the operating timing of a valve provided at a cylinder of the internal combustion engine with a good response.

Further, in the first aspect or second aspect of the present invention, the relative rotational phases of the valve drive cam and the pump drive cam may be set so that a timing at which the cam lift of the valve drive cam becomes maximum coincides with a timing at which the cam lift of the pump drive cam becomes maximum.

Even if doing this, it is possible to obtain actions and effects substantially the same as the first or second aspects. Note that here the relative rotational phases of the valve drive cam and the pump drive cam do not have to be set so that all of the timings at which the cam lift of the valve drive cam becomes maximum coincide with the timings at which the cam lift of the pump drive cam becomes maximum. It is sufficient that they be set so that at least once during one rotation of the valve camshaft, a timing at which the cam lift of the valve drive cam becomes maximum coincides with a timing at which the cam lift of the pump drive cam becomes maximum.

Further, in the first or second aspect of the present invention, the number of times that the valve drive cam drives operation of a valve during one rotation of the valve camshaft may be greater than the number of times that the pump drive cam drives the fuel pump during one rotation of the valve camshaft.

In such a case, for example, there will be causes where the number of cam lobes of the valve drive cam driving operation of a valve during one rotation of the valve camshaft is greater than the number of cam lobes of the pump drive cam. Even in such a case, substantially the same action and effects as the first or second aspects can be obtained.

Further, in the first or second aspect of the present invention, the operating timing of a valve provided in a cylinder of the internal combustion engine may be changed by supplying at least one oil pressure chamber through an oil path with working oil to operate an oil pressure operating actuator. As the device inhibiting the operating timing from being returned in a direction reverse to the direction of the targeted operating timing during change of the operating timing, a backflow prevention device functioning so that working oil does not flow back when working oil should be supplied to the oil pressure chamber may be provided with the oil path.

By this as well, it is possible to obtain actions and effects substantially the same as the first or second aspects.

Further, in the first aspect of the present invention, the relative rotational phases of the valve drive cam and the pump drive cam may be set so that the amount of fluctuation of the value of the composite reaction torque becomes less than a predetermined amount of fluctuation.

As explained above, if the amount of fluctuation of the value of the composite reaction torque becomes large, a drop in lifetime of the members transmitting power from the crankshaft to the valve camshaft will drop and other problems will arise. Therefore, if setting the relative rotational phases of the valve drive cam and the pump drive cam so that the amount of fluctuation of value of the composite reaction torque becomes less than a predetermined amount of fluctuation, by suitably setting the predetermined amount of fluctuation, it becomes possible to improve the response of control of the operating timing and prevent problems such as a drop in lifetime of the power transmitting members and other problems arising due to the larger amount of fluctuation of the value of the composite reaction torque.

Below, the present invention will be able to be understood more from the attached drawings and preferred embodiments of the present invention.

BRIEF DESCRIPTION OF DRAWINGS

FIG. 4*a* shows the valve drive cam, while FIG. 4*b* shows the pump drive cam.

FIG. 6*a* and FIG. 6*b* are views similar to FIG. 4*a* and FIG. 4*b* for another embodiment, wherein FIG. 6*a* shows the valve drive cam, while FIG. 6*b* shows the pump drive cam.

FIG. 7*a* and FIG. 7*b* are views similar to FIG. 4*a* and FIG. 4*b* for the case of applying the present invention to a 6-cylinder V-engine, wherein FIG. 7*a* shows the valve drive cam, while FIG. 7*b* shows the pump drive cam.

BEST MODE FOR CARRYING OUT THE INVENTION

Below, embodiments of the present invention will be explained with reference to the drawings.

Figure 1:
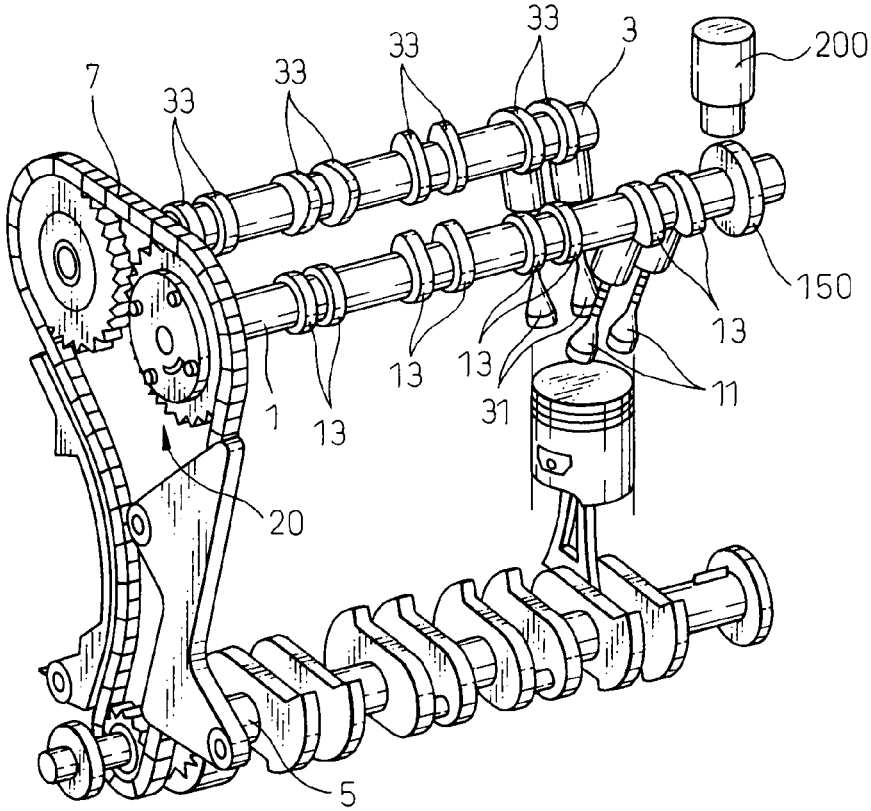
FIG. 1 is a view for explaining the arrangement of a camshaft of an embodiment applying the present invention to an automobile use in-line 4-cylinder DOHC engine.

FIG. 1 is a view for explaining the camshaft arrangement of an embodiment applying the present invention to an automobile use in-line 4-cylinder DOHC engine. In FIG. 1, 1 indicates an intake valve camshaft, 3 indicates an exhaust valve camshaft, and 5 indicates an engine crankshaft. The valve camshafts 1 and 3 are driven via a timing belt 7 synchronized with the crankshaft 5.

Further, in the present embodiment, each cylinder is provided with two intake valves 11 and two exhaust valves 31 for a total of four valves. Corresponding to these valves, the intake valve camshaft 1 is provided with two intake valve drive cams 13 for each cylinder, while the exhaust valve camshaft 3 is provided with two exhaust valve drive cams 33 for each cylinder.

Further, what is shown by 20 in FIG. 1 is an operating timing changing mechanism for changing the operating timing of the intake valves 11. That is, by operating the operating timing changing mechanism 20, it is possible to change the operating timings of the intake valves 11 to the advanced side or change it to the retarded side and thereby adjust the amount of valve overlap. Further, in the present embodiment, the operating timing changing mechanism 20 is controlled by oil pressure. That is, in the present embodiment, an oil pressure operation actuator, that is, the operating timing changing mechanism 20, is operated to change the operating timings. Note that the operation of the operating timing changing mechanism 20 will be explained in further detail later.

Figure 2:
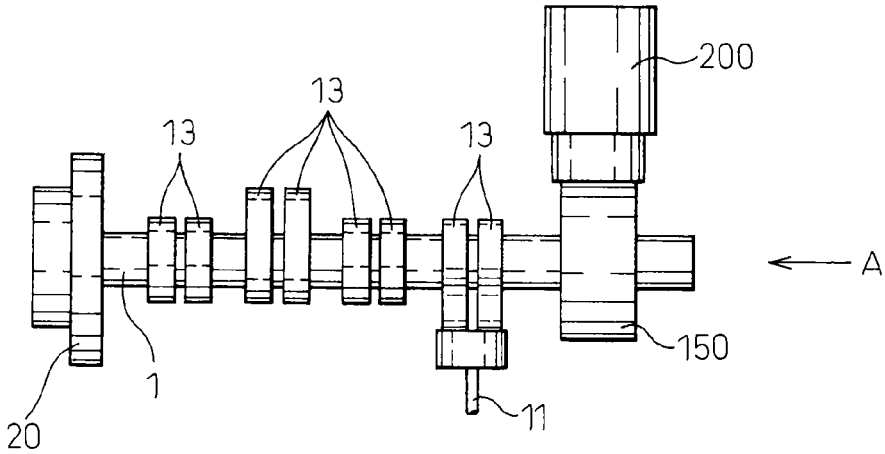
FIG. 2 is a view showing the part of the intake valve camshaft of FIG. 1.

Further, what is shown by 150 in FIG. 1 is a pump drive cam for driving a fuel pump 200. This is provided at the end of the intake valve camshaft 1. FIG. 2 is a view showing the part of the intake valve camshaft 1 of FIG. 1. As shown in the drawing, the pump drive cam 150 is engaged with an end of a plunger of the fuel pump 200 arranged at the upper side of the intake valve camshaft 1 (in FIG. 1, at the opposite side of the intake valve camshaft 1 from the crankshaft 5) and discharges fuel from the fuel pump 200 by pushing the plunger of the fuel pump 200 in the upward direction in synchronization with rotation of the intake valve camshaft 1.

Further, in a case like the present embodiment where the intake valve camshaft 1 is provided with the pump drive cam 150 in addition to the intake valve drive cams 13, the intake valve camshaft 1 receives fluctuation of the reaction torque (intake valve operation drive reaction torque) Tv accompanying driving of the operation of the intake valves 11 and also fluctuation of the reaction torque (fuel pump drive reaction torque) Tp accompanying driving of the fuel pump 200.

That is, in more detail, the intake valve operation drive reaction torque Tv acts as a torque in a direction inhibiting rotation of the intake valve camshaft 1 (positive torque) since the valve springs is compressed in periods before maximum positions of cam lift for driving intake valves 11 in the opening direction in the operation of the intake valve drive cams 13 and acts as a torque in the rotation direction of the intake valve camshaft 1 (negative torque) due to the springback forces of the valve spring in the periods after the maximum positions of cam lift for driving the intake valves 11 in the closing direction. Further, the fuel pump drive reaction torque Tp as well, in the same way as the intake valve operation drive reaction torque Tv, acts as a torque in a direction inhibiting rotation of the intake valve camshaft 1 (positive torque) in the periods before the maximum positions of cam lift in the operation of the pump drive cam 150 and acts as a torque in the rotation direction of the intake valve camshaft 1 (negative torque) in the period after the maximum positions of cam lift. Further, the intake valve camshaft 1 is acted upon by a composite reaction torque Tt of the intake valve operation drive reaction torque Tv and the fuel pump drive reaction torque Tp combined.

Figure 3:
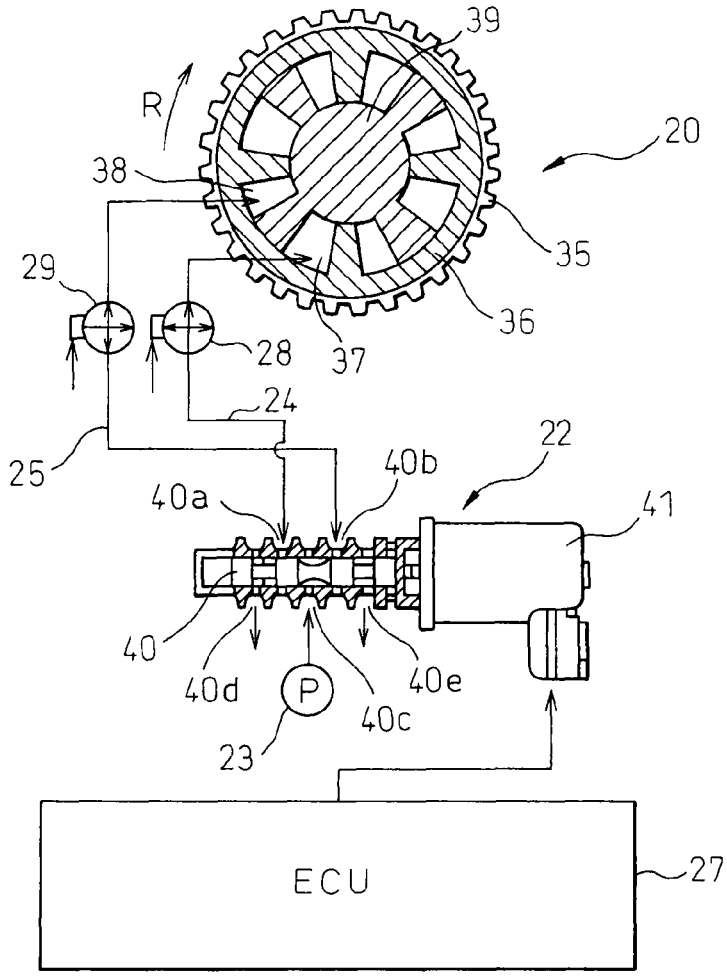
FIG. 3 is a view for explaining the operation of an operating timing changing mechanism.

Next, the operation of the operating timing changing mechanism 20 will be explained. FIG. 3 is a view for explaining the operation of the operating timing changing mechanism 20 in the present embodiment. In the figure, 20 indicates an operating timing changing mechanism, 22 indicates an oil control valve (OCV), and 23 indicates a working oil pump.

The operating timing changing mechanism 20 is a so-called vane type phase angle changing mechanism provided with a timing pulley 35 driven to rotate from the crankshaft 5 of the internal combustion engine by a timing belt 7, a housing 36 driven to rotate together with the timing pulley 35, and a vane member 39 arranged swivelably inside the housing 36, dividing the inside of the housing 36 into advancing oil pressure chambers 37 and retarding oil pressure chambers 38, and connected to the intake valve camshaft 1. In such an operating timing changing mechanism 20, by supplying working oil to an advancing oil pressure chamber 37 or a retarding oil pressure chamber 38, the housing 36 and vane member 39 are made to swivel with respect to each other to change the rotational phases of the crankshaft 5 and intake valve camshaft 1 and change the operating timings of the intake valves 11.

That is, by supplying working oil to an advancing oil pressure chamber 37 through an advancing side oil path 24 and draining working oil from a retarding oil pressure chamber 38 through a retarding side oil path 25, the vane member 39 is made to swivel relative to the housing 36 to a side where the phase angle is advanced, while by supplying working oil to a retarding oil pressure chamber 38 through the retarding side oil path 25 and draining working oil from an advancing oil pressure chamber 37 through the advancing side oil path 24, the vane member 39 is made to swivel relative to the housing 36 to a side where the phase angle is retarded. Further, when maintaining the phase angle at a constant phase angle, by controlling the working oil pressures inside the advancing oil pressure chamber 37 and the retarding oil pressure chamber 38 to the same pressures, the relative positions of the housing 36 and vane member 39 are held constant.

Such control of the working oil pressures inside the oil pressure chambers 37, 38, that is, control of the supply of working oil to these oil pressure chambers 37, 38, is performed by the OCV 22. The OCV 22 is a spool valve having a spool 40 provided with an oil pressure port 40*a* communicating with an advancing oil pressure chamber 37, an oil pressure port 40*b* communicating with a retarding oil pressure chamber 38, an oil pressure port 40*c* connected with the working oil pump 23 driven by the engine output shaft, and two drain ports 40*d*, 40*e*. The spool 40 of the OCV 22 operates to communicate either of the ports 40*a* and 40*b* with the port 40*c* and the other to a drain port.

That is, if the spool 40 moves in the left direction in FIG. 3, the port 40*a* communicated with an advancing oil pressure chamber 37 is connected through the port 40*c* to the working oil pump 23 and the drain port 40*d* is closed. Further, simultaneously at this time, the port 40*b* communicated with a retarding oil pressure chamber 38 is communicated with the drain port 40*e*. For this reason, working oil flows into the advancing oil pressure chamber 37 of the operating timing changing mechanism 20 from the working oil pump 23, raises the oil pressure in the advancing oil pressure chamber 37, and pushes the vane member 39 in the direction of the arrow R of FIG. 3 (advancing direction). Further, at this time, the working oil in a retarding oil pressure chamber 38 passes through the port 40*b* of the OCV 22 and is drained from the drain port 40*e*. For this reason, the vane member 39 swivels with respect to the housing 36 in the direction of the arrow R of FIG. 3.

On the other hand, if the spool 40 moves in the right direction in FIG. 3, the port 40*b* is connected to the port 40*c* and the port 40*a* is connected to the drain port 40*d*. Due to this, working oil flows into a retarding oil pressure chamber 38 and working oil is drained from an advancing oil pressure chamber 37, so the vane member 39 swivels with respect to the housing 36 in a direction reverse to the arrow R of FIG. 3. Further, when the spool 40 is at the neutral position shown in FIG. 3, the ports 40*a*, 40*b* are both closed.

What is shown by 41 in FIG. 3 is a linear solenoid actuator for driving the spool 40. The linear solenoid actuator 41 moves the spool 40 in accordance with a control signal from an electronic control unit (ECU) 27.

Furthermore, in the present embodiment, as shown in FIG. 3, the advancing side oil path 24 and retarding side oil path 25 are provided with control valves 28, 29 able to act as check valves at any time so that the working oil can be prevented from ending up flowing reverse to the intended direction.

That is, when supplying working oil to an advancing oil pressure chamber 37 through the advancing side oil path 24 to advance the operating timing, the control valve 28 provided at the advancing side oil path 24 is controlled to act as a check valve permitting only the flow of working oil heading toward the advancing oil pressure chamber 37, while at other times, it is controlled to act as a valve permitting flow in both directions. Further, when supplying working oil to a retarding oil pressure chamber 38 through the retarding side oil path 25 to retard the operating timing, the control valve 29 provided at the retarding side oil path 25 is controlled to act as a check valve permitting only the flow of working oil heading toward the retarding oil pressure chamber 38, while at other times, it is controlled to act as a valve permitting flow in both directions. Further, these control valves 28, 29 are also controlled by control signals from the ECU 27.

That is, in the present embodiment, the control valves 28, 29 function as backflow prevention devices functioning to prevent working oil from flowing back when working oil should be supplied to an advancing oil pressure chamber 37 or a retarding oil pressure chamber 38. Further, the control valves like the control valves 28, 29 may, for example, be configured providing inside the bodies of those control valves a pipe having a check valve, a pipe bypassing that check valve, and a switching valve switching paths between these two pipes. Note that, in the present embodiment, the control valves 28, 29 were made single-piece valves, but in other embodiments, so long as a similar function is achieved (that is, so long as the function of acting as a check valve at any time is realized), instead of the control valves 28, 29, for example, it is also possible to use a configuration having a pipe having a check valve, a pipe bypassing that check valve, and a switching valve switching paths between these two pipes. Furthermore, so long as a similar function is achieved, a completely different configuration may be used.

Further, in the present embodiment, assuming the above configuration, the relative rotational phases of the valve drive cams 13 and pump drive cam 150 are set as explained below so that the operating timings are able to be controlled with good response. That is, in the present embodiment, the relative rotational phases of the valve drive cams 13 and pump drive cam 150 are set considering utilization of the composite reaction torque Tt for changing the operating timing in the direction of the targeted operating timing (target operating timing) when changing the operating timing by the operating timing changing mechanism 20.

That is, more specifically, in the present embodiment, the relative rotational phases of the valve drive cams 13 and pump drive cam 150 are set so that the extent of fluctuation of the value of the composite reaction torque Tt combining the intake valve operation drive reaction torque Tv and the fuel pump drive reaction torque Tp becomes maximum. Further, by doing this, as explained later, it is possible to maximize the value of the composite reaction torque contributing to change of the operating timing in the direction of the target operating timing.

More specifically, in the present embodiment, the relative rotational phases of the valve drive cams 13 and pump drive cam 150 are set so that timings at which the cam lift of a valve drive cam 13 becomes maximum, coincide with the timings at which the cam lift of the pump drive cam 150 becomes maximum.

Figure 4A:
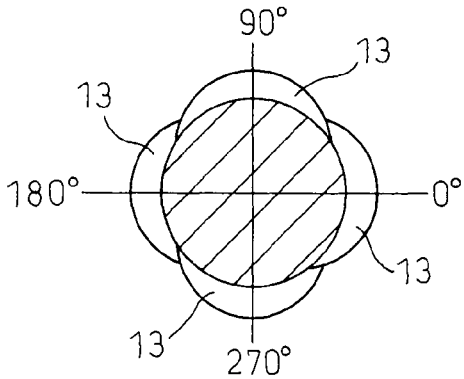
FIG. 4*a* and FIG. 4*b* are views for showing the relative rotational phases of a valve drive cam and pump drive cam and views in the case seen along the direction of the arrow A of FIG. 2.
Figure 4B:
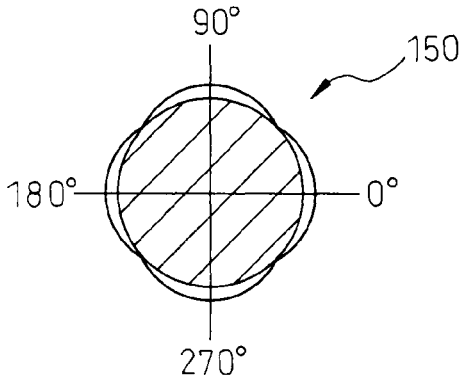

FIG. 4*a* and FIG. 4*b* are views for showing the relative rotational phases of a valve drive cam 13 and pump drive cam 150 in the present embodiment as seen from the direction of the arrow A of FIG. 2. FIG. 4*a* is a view shown for the valve drive cam 13, while FIG. 4*b* is a view shown for the pump drive cam 150.

Figure 5:
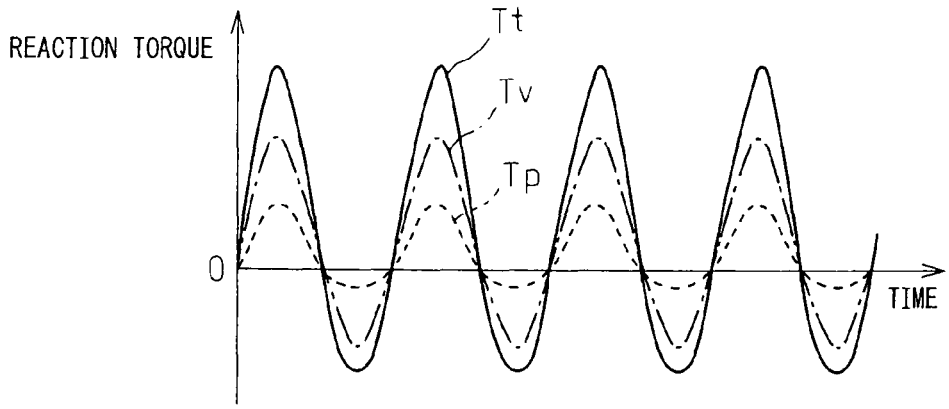
FIG. 5 is a view showing fluctuations of the valve operation drive reaction torque Tv, fuel pump drive reaction torque Tp, and composite reaction torque Tt acting on the intake valve camshaft.

Further, FIG. 5 is a view showing the fluctuations in the reaction torques Tv, Tp, and Tt acting on the intake valve camshaft 1 in the present embodiment. That is, as shown in FIG. 4*a* and FIG. 4*b*, if the relative rotational phases of the valve drive cam 13 and pump drive cam 150 are set so that the timings at which the cam lift of the valve drive cams 13 become maximum, coincide with the timings at which the cam lift of the pump drive cam 150 become maximum, as shown in FIG. 5, the fluctuation of the intake valve operation drive reaction torque Tv and the fluctuation of the fuel pump drive reaction torque Tp will match in phase and the amount of fluctuation of the composite reaction torque Tt combining these reaction torques Tv and Tp will become maximum.

In the fluctuation of the composite reaction torque Tt shown in FIG. 5, a part shown as a positive torque is a part where the torque acts in a direction inhibiting rotation of the intake valve camshaft 1, in other words, a part where the torque acts in a direction retarding the operating timing. Further, the part shown as a negative torque is a part where the torque acts in a direction of rotation of the intake valve camshaft 1, in other words, a part where the torque acts in a direction advancing the operating timing.

Further, in a case like the present embodiment wherein an operating timing changing mechanism 20 operated by oil pressure is used, the response in control is greatly influenced by not only the pressure of the working oil, but also the composite reaction torque Tt. This is because the vane member 39 of the operating timing changing mechanism 20 operated to change the rotational phase of the intake valve drive cam 13 ultimately is operated by the composite torque of the drive torque generated by the pressure of the working oil and the composite reaction torque Tt.

Further, first, considering here the case where the control valves 28, 29 are not provided, in this case, even if setting the relative rotational phases of the valve drive cam 13 and the pump drive cam 15 as shown in FIG. 4*a* and FIG. 4*b* so that the extent of fluctuation of the composite reaction torque Tt becomes maximum as shown in FIG. 5, it is considered not possible to obtain a sufficient improvement in response in control of the operating timing.

That is, if making the amount of fluctuation of the composite reaction torque Tt largest as shown in FIG. 5, the torque in the direction making the operating timing the target operating timing also becomes the maximum, but the torque trying to return the operating timing in a direction reverse to the direction of the target operating timing also becomes maximum. Further, when the control valves 28, 29 are not provided, working oil is not prevented from flowing back when working oil should be supplied to an advancing oil pressure chamber 37 or a retarding oil pressure chamber 38, so in particular when the oil pressure is not sufficiently high, during change of the operating timing, the operating timing will be returned in a direction reverse to the direction of the targeted operating timing. Therefore, in this case, when changing the operating timing, change one step forward and one step back is repeated until reaching the target operating timing and sufficient improvement in response could not be expected. Further, due to this, when the control valves 28, 29 are not provided, it can be said that the composite reaction torque Tt cannot be sufficiently utilized for changing the operating timing in the direction of the targeted operating timing.

On the other hand, in a case like the present embodiment where the control valves 28, 29 are provided, these control valves 28, 29 function so that working oil does not flow in reverse when working oil should be supplied to an advancing oil pressure chamber 37 or a retarding oil pressure chamber 38 to change the operating timing, therefore the operating timing is kept from being returned in a direction opposite to the direction of the target operating timing during change of the operating timing. Therefore, in a case like the present embodiment where the control valves 28, 29 are provided, there is no need to consider the case where the composite reaction torque causes the operating timing to end up being returned in a direction reverse to the direction of the target operating timing.

That is, in this case, in the composite reaction torque Tt, it is sufficient to consider only a part acting to change the operating timing in the direction of the target operating timing. This composite reaction torque Tt can be utilized for changing the operating timing in the direction of the target operating timing.

That is, for example, in the case of the present embodiment shown in FIG. 5, in fluctuation of the composite reaction torque Tt, regardless of the magnitude of the minimum value of the part shown as negative torque, the larger the maximum value of the part shown as a positive torque, the more improved the response when retarding the operating timing. Further, regardless of the magnitude of the maximum value of the part shown as positive torque, the smaller the minimum value of the part shown as negative torque, the more improved the response when advancing the operating timing.

Therefore, in the case like the present embodiment where the control valves 28, 29 are provided, by setting the relative rotational phases of the valve drive cam 13 and the pump drive cam 150 as shown in FIG. 4*a* and FIG. 4*b* so that the extent of fluctuation of the composite reaction torque Tt becomes maximum as shown in FIG. 5, the response in control of the operating timing can be improved.

In the above way, only in a case like the present embodiment where the control valves 28, 29 are provided, the composite reaction torque Tt can be utilized for changing the operating timing in the direction of the target operating timing. In this case, the relative rotational phases of the valve drive cam 13 and pump drive cam 150 are set considering the utilization of the composite reaction torque Tt for changing the operating timing in the direction of the target operating timing, so it is possible to efficiently utilize the composite reaction torque Tt for control of the operating timing and possible to improve the response of control of the operating timing. Further, as a result, it is possible to enhance the driveability, improve the fuel economy and exhaust emissions, etc.

Note that as explained above, it is learned that generally if the extent of fluctuation of the composite reaction torque Tt becomes larger, the problem of a drop in the lifetime of members transmitting power from the crankshaft to the valve camshaft etc. will arise. For this reason, in other embodiments, considering this point, it is also possible to set the relative rotational phases of the intake valve drive cam and the pump drive cam considering utilization of the composite reaction torque Tt for changing the operating timing and so that the amount of fluctuation of the value of the composite reaction torque Tt becomes less than a predetermined amount of fluctuation.

By doing this, by suitably setting a predetermined fluctuation extent, it is possible to improve the response of control of the operating timing while suppressing a drop in lifetime of the power transmission members and other problems arising due to the enlarged extent of fluctuation of the value of the composite reaction torque Tt.

Note that, in the above embodiment, as shown in FIG. 4*a* and FIG. 4*b*, the number of cam lobes of the valve drive cam 13 driving operation of the intake valve 11 during one rotation of the intake valve camshaft 1 and the number of cam lobes of the pump drive cam 150 were both made the same four lobes. That is, in the above embodiments, the number of times the valve drive cams 13 drive the operation of the intake valve 11 during one rotation of the intake valve camshaft 1 was the same as the number of times the pump drive cam 150 drive the fuel pump 200 during one rotation of the intake valve camshaft 1.

However, the present invention is not limited to this. In another embodiment, for example, the number of times an intake valve drive cam drives operation of an intake valve during one rotation of the intake valve camshaft may also be made greater than the number of times the pump drive cam drives the fuel pump during one rotation of the intake valve camshaft.

Figure 6A:
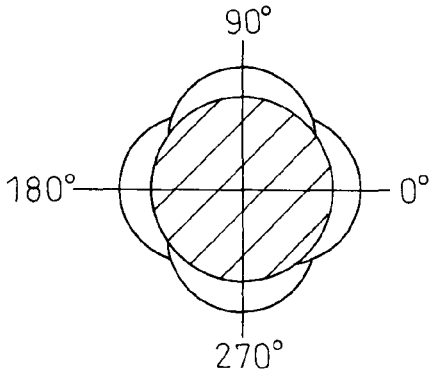
Figure 6B:
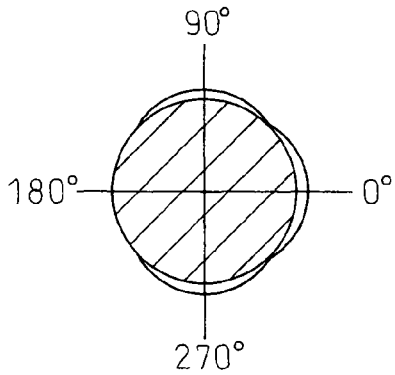

FIG. 6*a* and FIG. 6*b* are views similar to FIG. 4*a* and FIG. 4*b* showing a valve drive cam and a pump drive cam in an embodiment in this case. That is, FIG. 6*a* shows a valve drive cam, while FIG. 6*b* shows the pump drive cam. As shown in FIG. 6*a* and FIG. 6*b*, in this example, there are four cam lobes of the valve drive cam driving operation of the intake valve during one rotation of the intake valve camshaft, while there are three cam lobes of the pump drive cam. Therefore, in this case, the number of times an intake valve drive cam drives operation of an intake valve during one rotation of the intake valve camshaft is one time greater than the number of times the pump drive cam drives the fuel pump during one rotation of the intake valve camshaft. Further, the three cam lobes of the pump drive cam and three of the cam lobes of the four of the valve drive cam match in relative rotational phase.

Further, as clear from the explanation up to here, even if configured in this way, the extent of fluctuation of the composite reaction torque Tt is enlarged, so in the same way as the above embodiment, the operating timing can be controlled with a good response.

Figure 7A:
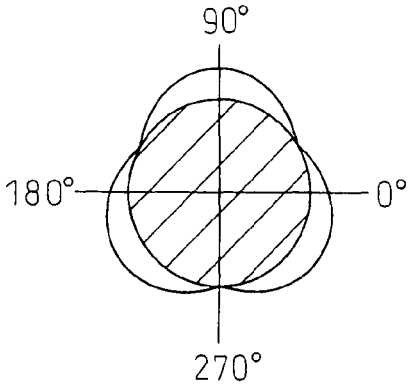
Figure 7B:
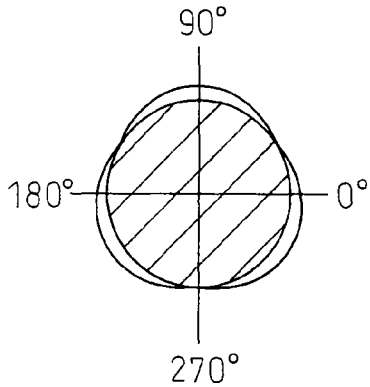

Further, in the above embodiment, the present invention was explained for an in-line 4-cylinder DOHC engine, but the present invention can also be applied to other types of internal combustion engines. For example, FIG. 7*a* and FIG. 7*b* are views similar to FIG. 4*a* and FIG. 4*b* showing an intake valve drive cam and pump drive cam for the case of application of the present invention to a 6-cylinder V-engine. That is, FIG. 7*a* shows an intake valve drive cam, while FIG. 7*b* shows a pump drive cam.

Furthermore, in the above embodiment, the operating timing changing mechanism 20 constituted by an oil pressure operating actuator was operated to change the operating timing, but the present invention is not limited to this. In other embodiments, means other than an oil pressure operating actuator may also be used to change the operating timing. Further, above, the case of changing the operating timing of an intake valve was explained, but it is clear that the present invention can be applied in exactly the same way to the case of changing the operating timing of an exhaust valve.

Note that, the present invention was explained in detail based on specific embodiments, but a person skilled in the art could make various changes, modifications, etc. without departing from the claims and idea of the present invention.

Further, the present application was filed along with a claim of priority based on Japanese Patent Application No. 2007-097651 filed on Apr. 3, 2007, the entire content of which basic application is incorporated by reference in the present description.

LIST OF REFERENCES

1 intake valve camshaft
3 exhaust valve camshaft
5 crankshaft
7 timing belt
11 intake valve
13 intake valve drive cam
20 operating timing changing mechanism
28 control valve
29 control valve
31 exhaust valve
33 exhaust valve drive cam
150 pump drive cam
200 fuel pump

The invention claimed is:

1. A control system of an internal combustion engine configured providing a valve camshaft provided with a valve drive cam for driving operation of a valve provided in a cylinder of the internal combustion engine with a pump drive cam so as to drive a fuel pump of the internal combustion engine, the system changing an operating timing of said valve provided in a cylinder of said internal combustion engine, wherein the control system has a device inhibiting the operating timing from being returned in a direction reverse to the direction of the targeted operating timing during change of the operating timing and relative rotational phases of said valve drive cam and said pump drive cam are set considering, for changing the operating timing in a direction of a targeted operating timing, utilization of a composite reaction torque of a valve operation drive reaction torque acting on said valve camshaft along with a driving operation of a valve provided in a cylinder of said internal combustion engine and a fuel pump drive reaction torque acting on said valve camshaft along with a driving operation of said fuel pump.

2. A control system of an internal combustion engine as set forth in claim 1, wherein the relative rotational phases of said valve drive cam and said pump drive cam are set so that a timing at which the cam lift of said valve drive cam becomes maximum, coincides with a timing at which the cam lift of said pump drive cam becomes maximum.

3. A control system of an internal combustion engine as set forth in claim 1, wherein the number of times that said valve drive cam drives operation of a valve during one rotation of the valve camshaft is greater than the number of times that said pump drive cam drives the fuel pump during one rotation of the valve camshaft.

4. A control system of an internal combustion engine as set forth in claim 1, wherein the operating timing of a valve provided in a cylinder of said internal combustion engine is changed by supplying at least one oil pressure chamber through an oil path with working oil to operate an oil pressure operating actuator, and, as the device inhibiting the operating timing from being returned in a direction reverse to the direction of the targeted operating timing during change of said operating timing, a backflow prevention device functioning so that working oil does not flow back when working oil should be supplied to said oil pressure chamber is provided with said oil path.

5. A control system of an internal combustion engine as set forth in claim 1, wherein the relative rotational phases of said valve drive cam and said pump drive cam are set so that the amount of fluctuation of the value of said composite reaction torque becomes less than a predetermined amount of fluctuation.

6. A control system of an internal combustion engine configured providing a valve camshaft provided with a valve drive cam for driving operation of a valve provided in a cylinder of the internal combustion engine with a pump drive cam so as to drive a fuel pump of the internal combustion engine, the system changing an operating timing of said valve provided in a cylinder of said internal combustion engine, wherein the control system has a device inhibiting the operating timing from being returned in a direction reverse to the direction of the targeted operating timing during change of the operating timing and relative rotational phases of said valve drive cam and said pump drive cam are set so that an amount of fluctuation of value of a composite reaction torque of a valve operation drive reaction torque acting on said valve camshaft along with a driving operation of a valve provided in a cylinder of said internal combustion engine and a fuel pump drive reaction torque acting on said valve camshaft along with a driving operation of said fuel pump becomes maximum.

7. A control system of an internal combustion engine as set forth in claim 6, wherein the relative rotational phases of said valve drive cam and said pump drive cam are set so that a timing at which the cam lift of said valve drive cam becomes maximum coincides with a timing at which the cam lift of said pump drive cam becomes maximum.

8. A control system of an internal combustion engine as set forth in claim 6, wherein the number of times that said valve drive cam drives operation of a valve during one rotation of the valve camshaft is greater than the number of times that said pump drive cam drives the fuel pump during one rotation of the valve camshaft.

9. A control system of an internal combustion engine as set forth in claim 6, wherein the operating timing of a valve provided in a cylinder of said internal combustion engine is changed by supplying at least one oil pressure chamber through an oil path with working oil to operate an oil pressure operating actuator, and, as the device inhibiting the operating timing from being returned in a direction reverse to the direction of the targeted operating timing during change of said operating timing, a backflow prevention device functioning so that working oil does not flow back when working oil should be supplied to said oil pressure chamber is provided with said oil path.

* * * * *